United States Patent [19]

Urdea

[11] 4,067,733

[45] Jan. 10, 1978

[54] HIGH STRENGTH ALUMINUM ALLOY

[76] Inventor: Myron G. Urdea, 1790 Panay Circle, Costa Mesa, Calif. 92626

[21] Appl. No.: 719,537

[22] Filed: Sept. 1, 1976

[51] Int. Cl.[2] ..... C22C 21/02

[52] U.S. Cl. ..... 75/147; 75/141; 75/142; 75/146; 148/3; 148/32.5; 148/159

[58] Field of Search ..... 75/147, 146, 141, 142; 148/32, 32.5, 159, 3

[56] References Cited

U.S. PATENT DOCUMENTS 2,908,566 10/1959 Cron et al. ..... 75/147

*Primary Examiner*—R. Dean

*Attorney, Agent, or Firm*—Knobbe, Martens, Olson, Hubbard & Bear

[57] ABSTRACT

An aluminum casting alloy having superior foundry characteristics, being heat-treatable to ultra-high yield strength, and containing from about 3 to about 10% silicon about 0.7 to about 1.5% magnesium, from about 0.03 to about 1% beryllium, and from 0.05 to 1% titanium and a method for preparing such alloys is disclosed.

3 Claims, 1 Drawing Figure

SOLUBILITY VERSUS TEMPERATURE OF MAGNESIUM SILICIDE IN SOLID ALUMINUM

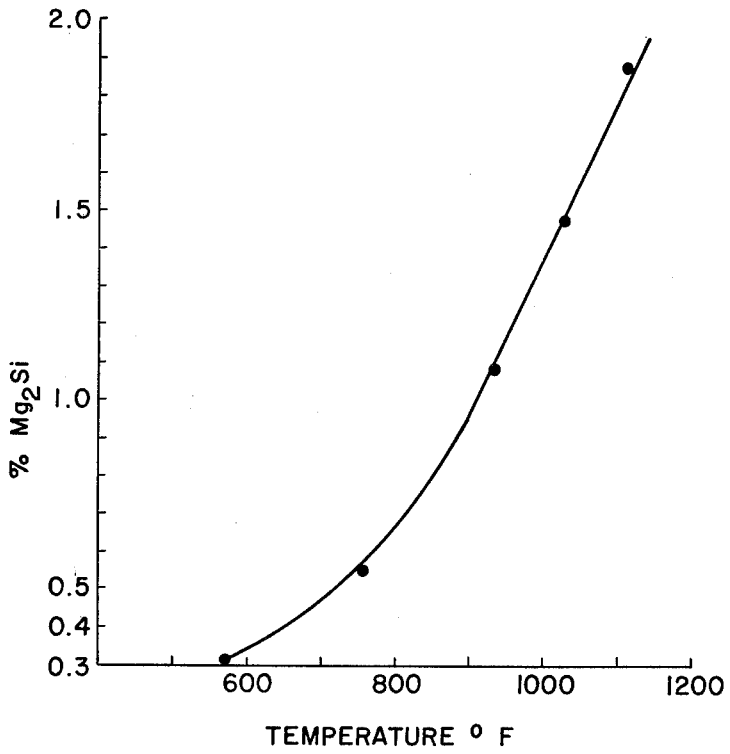
SOLUBILITY VERSUS TEMPERATURE
OF
MAGNESIUM SILICIDE IN SOLID ALUMINUM

HIGH STRENGTH ALUMINUM ALLOY

This invention relates to aluminum base heat-treatable alloy. More specifically, this invention relates to high beryllium content aluminum base heat-treatable alloys which possess superior foundry characteristics and are heat-treatable to attain ultra-high yield strengths without compromising general foundry characteristics.

In the specification and in the claims as contained herein, reference to ultra-high yield strengths means, as is generally accepted, above 45,000 PSI along with attendant mechanical and physical properties generally characterizing ultra-high strength aluminum based alloys.

The prior art is abundant in its disclosure of aluminum-base alloy compositions which have been designed for very specific purposes. In all cases, one or more important foundry characteristics have been compromised. A variety of aluminum containing and aluminum based alloys are disclosed in, for example, the following United States patents. U.S. Pat. No. 2,564,044, Willmore, Aug. 14, 1951 discloses aluminum-magnesium casting alloys and discusses the effect of boron and beryllium as an intensifier for grain refining of titanium and such alloys which contain from 3 to 9% magnesium as the major alloying element. U.S. Pat. No. 2,628,899, Willmore, Feb. 17, 1953, likewise discusses aluminum-magnesium casting alloys. Willmore points out that in such aluminum-magnesium alloys, boron alone is not a grain refiner but becomes a grain refiner when added to an alloy of this type which contains titanium. In the latter of the Willmore patents just mentioned, the alloy may contain from 1 to 9% magnesium and includes titanium as a grain refining additive which is intensified by the further addition of beryllium and/or boron. A similar disclosure for such alloys containing from 3 to 9% magnesium is given in U.S. Pat. No. 2,733,991, Willmore, Feb. 7, 1956. High magnesium containing aluminum alloys are also disclosed in U.S. Pat. Nos. 2,841,512 and 2,908,566. Nitride additives to aluminum alloys are disclosed by Marukawa et al, U.S. Pat. No. 3,551,143, Dec. 29, 1970, and the combined effect of magnesium and silicon additives to aluminum-based heat-treatable alloys is disclosed by Griffiths, U.S. Pat. No. 3,573,035, Mar. 30, 1971.

One of the features of this invention is that the disadvantages, in terms of loss of foundry characteristics, have been overcome by the novel alloy disclosed herein, designated as U-85. In addition, the alloy disclosed herein, U-85, is heat-treatable and contains ultra-high yield strength without sacrificing foundry characteristics.

This invention pertains to an alloy of aluminum-silicon-magnesium-beryllium which was tailored to be superior to other existing structural aluminum casting alloys. This was achieved by maximizing the effects of the major alloying elements but, importantly, by further discovering the parameters that enchance alloy properties. Some of these paramaters have been overlooked by other researchers in the development of known alloys with the consequence that the properties of the alloys varies extensively from heat lot to heat lot. The parameters delineated in this specification, but not thoroughly defined by other researchers, include the effect of impurities, the effect of alloying and optimum heat treatments.

The single FIRURE graphically portrays the solubility of magnesium silicide in aluminum.

High yield strength was chosen as one of the prerequisites of this alloy because all structural components are designed to yield strength levels. It is well known in the art that if the ductility of an aluminum alloy, as measured by elongation values, is 3% or more stresses induced during service can be distributed through the section such that premature failure will not occur. An alloy with high yield strength and good ductility is highly useful and very advantageous in many structural applications and, combined with superior foundry characteristics, high quality structural components can be easily and economically produced, using the alloy disclosed and claimed herein.

The major alloying elements of the alloy which is the subject of this invention, designated as U-85, are silicon, magnesium and beryllium. Each of these alloying constituents in their own way, contribute substantially to the properties of the alloy. Silicon, in aluminum casting alloys, imparts high fluidity, high corrosion resistance, good weldability, good machineability and low specific gravity. It also increases the strength of the alloy. Fluidity increases with the addition of silicon from 2% to 11.6%. Silicon contents about 8% seem to impede solidification such that a form of internal shrinkage results, which is detrimental to the strength of the alloy. 3% or more silicon is required to impart hot cracking resistance to aluminum casting alloys. The optimum range for silicon addition, according to this invention, is from about 5.5 to about 7.5% silicon, but silicon addition in the range from about 3% to about 10% still produce useable alloy compositions.

Magnesium as an additive to aluminum alloys increases fluidity, imparts low specific gravity and also contributes markedly to the strength by combining with silicon to form magnesium-silicide ($Mg_2Si$) a soluble constituent. Magnesium-silicide further enhances alloy properties by minimizing growth characteristics and by increasing corrosion resistance. While magnesium additive level in the range from about 0.7 to about 1.5% produces good results, the full advantage of this invention is available with magnesium additives in the range of from about 0.85 to 1.25% magnesium in the alloy.

Beryllium is an extremely valuable alloying additive. Beryllium addition protects aluminum, magnesium and silicon from oxidation, refines the cast grain size, prevents formation of embrittling constituents and, perhaps most importantly of all, enhances the heat-treatability of the alloy. As little as 0.005% beryllium improves oxidation resistance of aluminum-silicon-magnesium alloys; however, only in the range from about 0.03 to 0.30% beryllium improves the mechanical properties. Within this range, a specific critical range of from about 0.10 to about 0.30% provides optimum advantages, although some advantages are achieved by including beryllium in the alloy at levels as low as about 0.03 and as high as 1.00%.

Grain refiners such as titanium are essential to insure small grain size. The small grain size decreases the time required for solution heat treatment and also insures a more homogeneous structure resulting in a stronger alloy.

Titanium alone or titanium combined with boron are the best grain refiners for aluminum-silicon-magnesium alloys. There are limitations on the use of boron however. Titanium in the range of from about 0.05 to about 0.30% has been found to be particularly effective as a grain refiner in the alloy disclosed and claimed in this specification. Some interesting properties were, however, achieved with titanium additions up to about 1%.

A number of constituents often found in aluminum based alloys have been determined to have deleterious effects on aluminum-silicon-magnesium-beryllium alloys. Heretofore, however, other researchers have ignored or failed to recognize these deleterious effects. The following table briefly summarizes the deleterious effects as related to various concentrations.

| Element | Preferred Concentration | Limiting Concentration | Effect of Exceeding Concentration Limit |
|---|---|---|---|
| Iron | .15% Max. | .20% | Loss in Alloy Ductility |
| Manganese | .05% Max. | .10% | Forms low melting eutectic-limiting solutionizing temperature |
| Copper | .05% Max. | .10% | Same as manganese |
| Zinc | .05% Max. | .10% | Same as manganese |
| Lithium | NIL | .002% | Decreases heat treat response possibly through interaction with beryllium |
| Sodium | NIL | .002% | Same as lithium |
| Calcium | NIL | .002% | Lowers alloy strength by drastically reducing solubility of silicon |
| Boron | .003% Max. | .01% | Decreases heat treat response |

It is further instructive to compare the foundry characteristics of this invention, U-85 alloys, with foundry characteristics of other alloys. This comparison is presented in the following table:

| Item | Foundry Characteristic | 354 | C355 | A356 | A357 | 359 | TENS-50 | KO-1 | U-85 |
|---|---|---|---|---|---|---|---|---|---|
| 1 | Fluidity | 1 | 2 | 2 | 2 | 1 | 2 | 2 | 1 |
| 2 | Resistance to Hot Cracking | 2 | 2 | 1 | 1 | 1 | 1 | 5 | 1 |
| 3 | Shrink Tendency | 2 | 2 | 1 | 1 | 2 | 1 | 2 | 1 |
| 4 | Pressure Tightness | 1 | 2 | 1 | 1 | 1 | 1 | 3 | 1 |
| 5 | Corrosion Resistance | 3 | 2 | 1 | 1 | 1 | 1 | 4 | 1 |
| 6 | Average Yield Strength Obtainable | 2 | 5 | 5 | 3 | 4 | 3 | 1 | 1 |

Code: Items 1–5, 1-Excellent, 2-Good, 3-Fair, 4-Poor, 5-Very Poor. Item 6, 1-Above 45,000 PSI, 2-45,000 PSI Max., 3-40,000 PSI Max., 4-38,000 PSI Max., 5-35,000 PSI Max.

The alloys listed in this table fall into four basic families of alloys. A356 and 359 are of the aluminum-silicon-magnesium family, 354 and C355 are of the aluminum-silicon-magnesium-copper family, A357, TENS-50 and U-85 are of the aluminum-silicon-magnesium-beryllium family and KO-1 is of the aluminum-copper-magnesium-silver family. It is obvious that the aluminum-silicon-magnesium-beryllium family by far possesses the inherent properties required to produce alloys with excellent overall foundry characteristics. It is also evident that alloys containing copper are inferior in foundry characteristics to alloys void of copper.

U-85 alloy is most easily produced starting with a low impurity aluminum-silicon-magnesium alloy such as A356. Beryllium is added as an aluminum-beryllium hardener containing approximately 5% beryllium. Magnesium may be added as pure magnesium or as an aluminum-magnesium hardener, but never as a zinc containing alloy or an alloy which contains any other impurity in a level which would be detrimental, as set forth in the preceding table which discusses the detrimental level of impurities. Titanium recovery is best achieved through using aluminum-titanium hardeners.

It was discovered that the sequence of addition of the alloying elements, as well as the method and temperatures of introduction, was extremely important in element recovery. It was found, for example, when beryllium was added first that the efficiency of both magnesium and titanium recovery approached 100% of the quantity introduced. This is significant since magnesium content in U-85 is extremely critical. This benefit is possibly a result of the ability of beryllium to protect the melt and the alloying elements from oxidation. A temperature range of from 1350° to 1400° F for all additions was found to be optimum.

As is required in the production of premium quality castings, good foundry techniques are necessary to insure reliability in casting U-85. Good directional solidification, minimum turbulence during pouring, rapid solidification and low hydrogen content in the melt are prerequisites to producing quality castings. The first three requirements can be insured through the use of sound foundry engineering principles. The most elusive item is to control hydrogen content of the melt, since many variables contribute to this condition, from atmosphere humidity to ladel temperature.

A technique for reliably controlling hydrogen content in U-85 was developed. This technique can also be used for any molten aluminum alloy. The technique consists of bubbling nitrogen through the molten metal continuously during casting. The rate of nitrogen can easily be metered but qualitatively a gentle breaking bubble that breaks the oxide surface with minimum turbulence is the best gauge of nitrogen volume required.

It is extremely vital that fluxes containing detrimental constituents, as tabulated above, not be used since they tend to contaminate the alloy. The two best solid fluxes that can be used, as presently understood, in combination with nitrogen are aluminum chloride and hexachloroethane.

As is the case with any heat treatable aluminum alloy, all proper processing techniques are valueless if poor heat treatment procedures are employed. To achieve optimum properties in U-85 alloys, strict heat treatment procedures must be adhered to. U-85 has been tailored in composition to take full advantage of the precipitation hardening effects of magnesium silicide. The stoichiometric amounts of magnesium and silicon in magnesium silicide are 63.3% and 36.7% respectively, giving a 1.73 magnesium to a 1.0 silicon ratio. From the drawing, to which reference is now made, it can be seen that the solubility of magnesium silicide in solid aluminum varies drastically with temperature, ranging from about 0.3% at 600° F to about 2% at about 1200° F.

Since the lowest melting eutectic in U-85 alloy is Al-$Mg_2Si$-Si (aluminum-magnesium silicide-silicon) which melts at 1038° F, this alloy can be safely solutionized at up to 1020° F with proper furnace control. The optimum amount of magnesium silicide that will go into complete solution at 1020° F is 1.46%, yielding, on a stoichiometric basis, magnesium content at 0.92%. Excess silicon in the alloy does not affect the solubility of magnesium silicide. It is necessary for all the available magnesium silicide to be soluble at the solutionizing temperature because undissolved magnesium silicide does not contribute to alloy strength. Only dissolved magnesium silicide will precipitate upon reheating to aging temperature to give rise to the precipitation hardening reaction. The role of beryllium in U-85 alloy was discussed earlier; however, a very special condition develops during cooling from solutionizing temperature with magnesium silicide alloys containing beryllium. The beryllium modifies the precipitation reaction by migrating to dislocation sites and not only changes the mode of magnesium silicide precipitation but manifests a psuedo-dispersion hardening effect. This combined reaction results in an alloy with ultra-high yield strengths when all other conditions are optimum.

The complete heat treat cycle found ideal for U-85 alloy is as follows:

a. Solutionize at 1020° F ± 5° F for 16 to 24 hours b. Quench within 10 seconds in cool water, preferably to 120° F or less, depending upon section thickness.

c. Age at room temperature for 18 to 48 hours.

d. Age at 350° F ± 5° F for 8 to 10 hours.

As demonstrated above in the table which compares commercial alloys with the alloy of this invention, U-85, it is clear that the foundry characteristics of the alloy of this invention are superior in most or all respects to all other commercial alloys which have a high-strength capability. This combination of high-strength heat-treatable capability along with excellent foundry characteristics is unique in the industry.

This unexpected and unpredictable advantage results from the discovery and the appreciation of the positive effects of alloying constituents in specified concentration levels coupled with the discovery and recognition of the deleterious effects, including the combined deleterious effects of various minor constituents and the combined maximizing of the position benefits and the elimination of the negative detriments of the various constituents. The aluminum casting alloy of this invention achieves superior foundry characteristics and is heat-treatable to ultra-high yield strengths and contains from about 5.5 to about 7.5% silicon, 0.85 to 1.25% magnesium, 0.10 to 0.30% beryllium, 0.05 to 0.30% titanium, less than 0.2% iron, less than 0.1% manganese, copper and zinc, less than 0.01% boron and less than 0.002% lithium, sodium and calcium.

Still unexpected but not quite so advantageous results can be obtained in alloys having a slightly broader range of constituents, for example, aluminum casting alloys which also maintain superior foundry chraracteristics and are heat treatable to extremely high-yield strength and which include from about 3.0 to about 10% silicon, from about 0.7 to 1.5% magnesium, from about 0.03 to about 1% beryllium, from about 0.05 to about 1% titanium and, as before, less than 0.2% iron, less than 0.1% manganese, copper and zinc less than 0.01% boron and less than 0.002% lithium, sodium and calcium.

These advantages are accomplished by minimizing the effect of hydrogen by continuously bubbling nitrogen through the melt during the addition of the constituents and and processing of the alloy. Optimum ultra-high yield strengths are accomplished by solutionizing at about 1020° F for about 16 to 24 hours, quenching within 10 seconds in cool water, preferably to 120° F or less, aging at room temperature for from about 18 to 48 hours followed by aging at about 350° F for from about 8 to about 10 hours.

It will be apparent that within the parameters of the foregoing teachings, there is considerable room for variation without departing from the spirit and scope of the invention and without loss of the advantages and unexpected results accomplished thereby, and as defined in the following claims:

I claim:

1. An aluminum casting alloy having superior foundry characteristics and being heat treatable to ultra-high yield strength consisting essentially of from about 5.5 to about 7.5% silicon, about 0.85 to about 1.25% magnesium, about 0.10 to about 0.30% beryllium, about 0.05 to about 0.30% titanium and containing less than 0.20% iron, 0.10% manganese, copper and zinc, 0.01% boron and 0.002% lithium, sodium and calcium, balance aluminum.

2. The method of obtaining ultra-high yield strength aluminum alloy consisting essentially of casting molten alloy having the composition defined in claim 1 and then heat treating said cast alloy by solutionizing said alloy at about 1020° F for about 16 to about 24 hours, then quenching said alloy within 10 seconds in cool water to about 120° F or less, aging the cooled alloy at room temperature from about 18 to about 48 hours, and thereafter aging the alloy at about 350° F for about 8 to about 10 hours.

3. The method defined in claim 2 further including the step of bubbling nitrogen through said molten alloy continuously during casting to minimize the introduction and effect of hydrogen on the alloy.

* * * * *